US006213217B1

(12) United States Patent
Wilson et al.

(10) Patent No.: US 6,213,217 B1
(45) Date of Patent: Apr. 10, 2001

(54) GAS OPERATED APPARATUS AND METHOD FOR MAINTAINING RELATIVELY UNIFORMED FLUID PRESSURE WITHIN AN EXPANDABLE WELL TOOL SUBJECTED TO THERMAL VARIANTS

(75) Inventors: Paul J. Wilson, Houston, TX (US); James V. Carisella, Harahan, LA (US)

(73) Assignee: Weatherford International, Inc., Houston, TX (US)

( * ) Notice: Subject to any disclaimer, the term of this patent is extended or adjusted under 35 U.S.C. 154(b) by 0 days.

(21) Appl. No.: 09/292,530

(22) Filed: Apr. 15, 1999

(51) Int. Cl.[7] ..... E21B 33/127
(52) U.S. Cl. ..... 166/387; 166/187
(58) Field of Search ..... 166/383, 387, 166/187, 134, 120, 135

(56) References Cited

U.S. PATENT DOCUMENTS

| | | | | |
|---|---|---|---|---|
| 3,160,211 | | 12/1964 | Malone . | |
| 4,345,648 | | 8/1982 | Kuus | 166/106 |
| 4,349,204 | | 9/1982 | Malone | 277/34 |
| 4,589,484 | | 5/1986 | Doherty et al. | 166/179 |
| 4,655,292 | | 4/1987 | Halbardier | 166/387 |
| 4,832,120 | | 5/1989 | Coronado | 166/187 |
| 4,869,324 | | 9/1989 | Holder | 166/387 |
| 5,046,557 | | 9/1991 | Manderscheid | 166/120 |
| 5,117,685 | * | 6/1992 | Goldschild | 166/319 |
| 5,320,182 | | 6/1994 | Mendez | 166/387 |
| 5,417,289 | | 5/1995 | Carisella | 166/387 |
| 5,469,919 | | 11/1995 | Carisella | 166/387 |
| 5,495,892 | | 3/1996 | Carisella | 166/387 |
| 5,564,504 | | 10/1996 | Carisella | 166/387 |
| 5,718,292 | | 2/1998 | Heathman et al. | 166/387 |
| 5,813,459 | | 9/1998 | Carisella | 166/187 |

FOREIGN PATENT DOCUMENTS

| | | |
|---|---|---|
| 0290114 | 11/1988 | (EP) . |
| WO9836152 | 8/1998 | (WO) . |

OTHER PUBLICATIONS

Article entitled, "Proven Elastomer Compound for Extremely Hostile Geothermal and Oil Field Environments", by Hirasuna, et al., IADC/SPE 11407; 1983 Drilling Conference; Feb. 1983.

Article entitled, "Design and Testing of a High–Performance Inflatable Packer", by Eslinger, et al., SPE 37483; 1997 Production Operations Symposium; Mar. 1997.

* cited by examiner

*Primary Examiner*—William Neuder
(74) *Attorney, Agent, or Firm*—Fulbright & Jaworski L.L.P.

(57) ABSTRACT

A thermal compensating apparatus method for maintaining a substantially constant fluid pressure within a subterranean well tool of the type that includes a bladder that is selectively expandable upon the introduction of pressurized actuation fluid for actuating said tool at a location in a well. A body includes first and second fluid chambers. The first fluid chamber houses a substantially incompressible fluid and communicates with the actuating fluid used for activating said tool in the well. The second fluid chamber is charged with a compressible fluid. Both chambers define first volumetric sizes within the body upon actuation of said tool in the well. The fluid chambers are operatively connected to each other without transmitting fluid there between so that changes in the volumetric size of the first chamber caused by temperature variations in the actuation fluid will change the volumetric size of the second fluid chamber for maintaining the actuating fluid at a substantially constant pressure.

16 Claims, 6 Drawing Sheets

GAS OPERATED APPARATUS AND METHOD FOR MAINTAINING RELATIVELY UNIFORMED FLUID PRESSURE WITHIN AN EXPANDABLE WELL TOOL SUBJECTED TO THERMAL VARIANTS

BACKGROUND OF THE INVENTION

1. Field of the Invention

The invention relates generally to subterranean well tools such as inflatable packers, bridge plugs or the like, which are set through the introduction of fluid into an expandable elastomeric bladder and, more particularly, to a gas operated apparatus and method for maintaining a relatively uniform fluid pressure in the bladder when the tool is subjected to thermal variants after setting.

2. Description of Problems

It is known among those skilled in the use of these types of inflatable devices that they are subject to changes in inflation pressure when the temperature of the inflation fluid varies from its initial inflation temperature. Typically, an increase in fluid temperature results in increased inflation pressures, and a decrease results in decreased inflation pressures. An increase in inflation pressure can make the tool susceptible to burst failure. A decrease in inflation pressure can diminish anchoring between the tool and the well bore to a point where the tool is not able to provide its intended anchoring function. In both instances, significant changes in temperature in the inflation fluid can result in compromised tool performance and possible tool failure. These failures can result in significant monetary loss and possible catastrophe.

The magnitude of temperature change needed to adversely affect the performance of an inflatable tool depends upon a number of parameters, such as, for example (1) the expansion ratio of the inflation element, (2) the relative stiffness of the steel structure of the inflation element compared with the compressibility and thermal expansion coefficient of the inflation fluid, (3) the relative stiffness of the casing and/or formation compared with the compressibility and thermal expansion coefficient of the inflation fluid, and (4) the anelastic properties of the elastomeric components in the inflation element. There are other factors of lesser significance known to those skilled in the relevant art.

Regardless of the specific values of the aforementioned parameters, conventional inflatable tools cannot tolerate positive or negative temperature changes greater than about 10°–15° F. (5.6–8.3 C.°) from the initial temperature at the end of their inflation cycle. If the temperature of the inflation fluid varies by more than this amount, the tool is subjected to excessive inflation pressures or insufficient inflation pressures, which could result in tool performance problems of the nature described above.

In addition, cycling the inflation fluid temperature within a ±15° F. of the initial temperature upon expansion can cause stress cycling in the steel structure of the inflation element and in the bladder. There is the potential for a serious problem when the inflation element survives routine thermal cycling for a finite period of time, during which cyclic damage in the tool accumulates. In such a case, failure can occur at some time after the rig has departed from the well site. Thus, an inflatable tool can provide short term functional performance during low magnitudes of thermal cycling. However, cumulative damage phenomena can occur in steel structures and/or elastomeric components and eventually cause device failure.

A time delayed failure can be more costly and possibly more catastrophic than one which occurs within a short time after the initial setting of the tool. Replacement of the failed device would entail performing a second project about equal in size and expense to the first service operation, instead of the case of a short-lived tool which would fail before the rig is broken down and moved off the site. Operations of this type can cost in excess of one hundred thousand dollars, and as high as several millions of dollars.

There are many operations in the oil and gas industry that successfully use pressure isolation devices which routinely encounter substantial thermal excursions and substantial magnitudes of combined positive and negative thermal cycling. Typically, inflatable devices are excluded as candidates for such projects. Typical projects are listed below.

large volume stimulation projects, n selective zone treatment projects, n large volume cement squeeze projects, n production packer service in oil and/or gas wells experiencing cooling from Joules-Thompson expansion and cooling of gases, n,c production packer service in oil and/or gas wells experiencing heating from deeper produced fluids, p,c conversion of a producing well to an injection well and temporary isolation between perforation intervals, n,c huff/puff steam injection methods for producing viscous oil formations, p,c

[n=these operations typically result in a large negative thermal excursion (cooling) in the pressure isolation device.]

[p=these operations typically result in a large positive thermal excursion (heating) in the pressure isolation device.]

[c=these projects typically repeated multiple thermal cycling in the pressure isolation device over long periods of time.]

The first five project categories are very common in the industry. Thousands of them are performed per year. The bottom two categories are relatively infrequent with respect to world wide activities.

If conventional packers and bridge plugs are not able to provide service for a given well configuration, because they are not able to pass through restrictions and subsequently set in casing, it is common to use a rig to pull tubing and perform a costly work-over project. The use of thru-tubing inflatable devices provides well known benefits and versatility to the oil and gas industry. Their lack of service worthiness for operations that include thermal cycling and thermal excursions exclude them from a substantial portion of the remedial service sector. An invention that would eliminate the deleterious effects of routine thermal excursions and thermal cycling, would eliminate the aforementioned problems, augment the benefits and versatility of inflatable devices and provide substantial cost savings to operators in the industry.

3. Description of the Prior Art

Subterranean well tools, such as conventional packers, bridge plugs, tubing hangers, and the like, are well known to those skilled in the art and may be set or activated a number of ways, such as mechanical, hydraulic, pneumatic, or the like. Many of such devices contain sealing mechanisms which expand radially outwardly as the device is set in the well to provide a seal in the annular area of the well between the exterior of the device and the internal diameter of well casing, if the well is cased, other tubular conduit, or along the wall of open borehole, as the case may be.

Frequently, the seal is established subsequent to the setting of such device in the well and will be adversely effected by temperature variances of the device or in the vicinity of the device. Such temperature variances can cause expansion or contraction of the sealing mechanism, thus jeopardizing the sealing and even anchoring integrity of the device over time. For example, such devices are typically utilized in well stimulation jobs in which an acidic composition is injected into the formation or zone adjacent a well packer or bridge plug. As the stimulation fluid is injected into the zone, the temperature of the device and the well bore immediate the formation will be reduced.

If, for example, the well tool utilizes a sealing mechanism that includes an inflatable elastomeric bladder, the temperature of the fluid utilized to inflate the bladder and retain same in set position in the well is affected by the temperature reduction during the stimulation job, causing a reduction of pressure within the interior of the bladder, fluid chambers and communicating passageways within the tool. This reduction in pressure, in turn, causes the bladder to contract from the initial setting position. In more dramatic situations, anchoring of the device in the well bore can be lost and the differential pressures across the device can cause "corkscrewing" of the coiled tubing or work string, resulting in project failure, expensive solution of the corkscrew problem and substantial operational risks.

On the other hand, the same inflatable tool is also adversely affected by an increase in device temperature during certain types of secondary and tertiary injection techniques utilizing, for example, the injection of steam. As the steam is injected into the zone of the well immediate the set packer or well plug, the zone and accompanying devices, including tubing, quickly become exposed to the increased temperature. Some prior art devices containing inflatable packer components have been known to have the inflatable bladder element actually rupture, due to exposure to increased pressure within the bladder and interconnected chambers and passageways as steam flows through the device and is injected into the well zone.

In U.S. Pat. No. 4,655,292, entitled "Steam Injection Packer Actuator and Method," a device is shown and disclosed, which addresses the problems associated with the prior art by providing a mechanism incorporating a compressible fluid, such as nitrogen gas. The fluid is used to accommodate an increase in temperature during steam injection and other operations for preventing the packer mechanism from rupturing as a result of exposure to enhance pressures resulting from the increase of temperature of inflation fluid and device components as stream flows through the device.

The present invention addresses the problems associated with prior art devices by maintaining a relatively constant inflation pressure even when the device experiences single and/or multiple thermal excursions of substantial magnitude. The invention operates to abate the adverse effects of any combination of heating and cooling, both quasi-static and dynamic cycling.

SUMMARY OF THE INVENTION

The present invention provides a gas operated thermal compensating apparatus and method for maintaining a relatively constant pressure in a down hole tool with an inflatable bladder so that the integrity of the seal and anchor of the tool is not compromised. The tool of the present invention includes a housing or body in which first and second fluid chambers are provided. The first fluid chamber houses a substantially incompressible actuating fluid, for example, water, an aqueous based setting fluid, a cementitious fluid, or the like, all of which are well known to those skilled in the art for the setting of inflatable packers and like mechanisms. The first fluid chamber communicates with the interior of the tool, in known fashion, so that the actuating fluid which effects inflation or other expansion of sealing elements into sealing engagement with the interior wall of the casing or the open borehole, is also contained in the first fluid chamber.

The second fluid chamber contains a compressible fluid which is injected into the chamber prior to the well tool being run into the well. Both of the fluid chambers have a pre-determined initial volumetric size upon completion of the setting of the tool in the well. The volumetric size of the second fluid chamber is varied in response to thermal expansion or contraction of the actuating fluid in the first chamber due to positive and negative temperature changes subsequent to the setting of the tool.

Such volumetric changes are accomplished via the use of floating pistons disposed within the housing. One piston is positioned between the chambers. A second piston, through one face, defines the lowermost end of the first chamber in which the compressible fluid is located. A second face of the second piston is exposed to hydrostatic well pressure.

In one embodiment, the second chamber is designed so that its volumetric size (at the end of the setting operation) is about five percent (5%) of the volumetric size of the first chamber (at the end of the setting operation). Proportioning the volumetric sizes of the two chambers in this way allows the invention to impart quasi-static pressure maintenance over positive and negative thermal excursions slightly greater than 100° F. (55.6 C.°). This represents a 200° F. operating range. All but one of the bullet items described above, have been found to have thermal excursion amplitudes and thermal cycle ranges less than 200° F. (111.1 C.°).

While on the surface and prior to being run in the well, the thermal compensating apparatus is prepared for service by injecting a compressible fluid into the volumetric space between the two floating pistons. The pressure of the fluid is increased until it reaches a preselected value or "charge pressure". The magnitude of the charge pressure is determined by a combination of parameters, for example, (1) the type of compressible fluid used, (2) its compressibility and thermal expansion characteristics, (3) the anticipated hydrostatic pressures above and below the inflatable device for the entire service period of the device, (4) the anticipated device temperatures for the entire service period of the device, and (5) the type of inflation fluid in the first chamber and its compressibility and thermal expansion characteristics.

Each of these parameters should be considered in determining the proper preparation of the invention and assurance of desired function.

When the thermal compensating apparatus and method are incorporated into an inflatable device, a relatively constant pressure is maintained in the first and second chambers. For example, when a conventional 2½" run-in diameter inflatable bridge plug is set in 7"–29 ppf casing and nitrogen gas is used as the compressible fluid, the following parameters will result in the pressure in both chambers varying by approximately 1.80 psi for per F.° (1.0 psi per C.°) as the temperature of the fluid in the first chamber varies, which for all practical purposes will maintain the pressure in the first chamber substantially constant for temperature changes within ±100° F. (55.55° C.):

1. a charge pressure of 1,050 psia (72.4 bars) at 70° F.;
2. a setting pressure at the end of the setting operation in the first and second chambers at 4,350 psia (300 bars); and
3. an initial temperature in the tool (and fluid in the first chamber) of 250° F. (121° C.).

With regard to physical characteristics of the apparatus, the volumetric size of the first chamber at the end of the setting operation is determined by the expansion ratio for that tool in each specific service job. Almost all projects that use thru-tubing inflatable devices have an expansion ratio less than 3.25:1. Many projects performed in the world-wide industry have expansion ratios less than 3:1, and most of them have expansion ratios less than 2.5:1. The volumetric size of the second chamber in an actual tool can be designed to satisfy service conditions for a 3.25:1 expansion ratio and a 200° F. thermal cycle range. The tool and method of the present invention can provide quasi-static pressure maintenance over a thermal cycle range greater than 200° F. for all applications where the expansion ratio is less than 3.25:1. This versatility benefits users because they only need to inventory and maintain one size of the invention in order to satisfy all service jobs for each size of inflatable tool.

DESCRIPTION OF THE DRAWINGS

A better understanding of the invention can be obtained when the detailed description of preferred embodiments described below is considered in conjunction with the appended drawings, in which.

DESCRIPTION OF PREFERRED EMBODIMENTS

Figure 1:
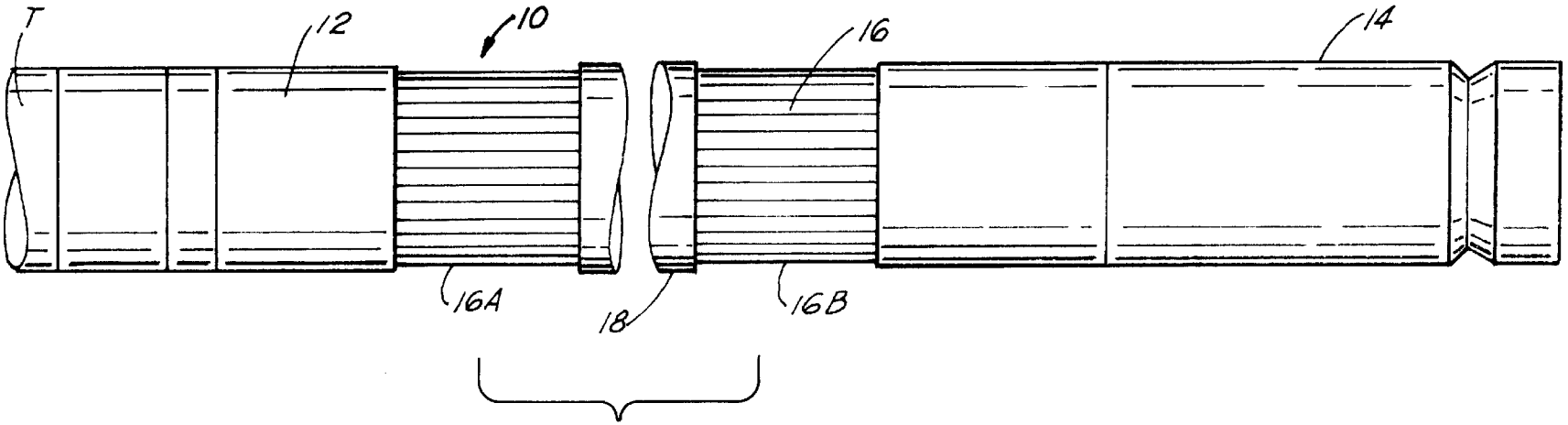
FIG. 1 is a plan view of an unexpanded tool, such as an inflatable packer, in which the present invention can be utilized.

Referring first to FIG. 1, a down hole tool such as an inflatable packer 10 is shown, in which the invention can be used. The invention can also be used in many other types of down hole tools which utilize inflatable elements of the type described. The packer 10 includes upper and lower collars 12, 14, respectively. The packer 10 is connected in conventional fashion, such as by threads, connector, or otherwise, through the upper collar 12 to a carrier T extending to the top of the well. The carrier T may be a tubular conduit, such as coiled tubing, a section of work string, electric line, or the like.

The packer 10 includes a series of metallic ribs or slats 16 which overlap and extend longitudinally between the collars 12, 14, in conventional fashion. A conventional bladder (not shown) formed of an elastomeric material is provided beneath the ribs 16, which can be expanded through the introduction of pressurized fluid from any number of sources in a well known way.

The tool 10 includes exposed rib sections 16A and 16B that are separated by an elastomeric cover or seal section 18. Although an arrangement is shown in FIG. 1 where two exposed rib sections are separated by a cover section, the invention can be applied to expandable tools of any number of sizes and configurations, and is not limited to the tool illustrated in FIG. 1.

When pressurized fluid is introduced into the bladder causing it to expand (not shown), the ribs 16 and cover section 18 expand outwardly into contact with the casing or other conduit in which the tool 10 is located. Typically, the exposed anchor sections 16A, 16B, operate as an anchor for the tool, while the cover section 18 operates as a seal.

The thermal compensating apparatus of the present invention is shown in FIGS. 2–6, and is generally identified by reference number 20. The apparatus 20 is connected to the tool 10 shown in FIG. 1 through a sleeve 19 that is connected to the lower collar 14 of the tool 10. In other words, the apparatus 20 is located below the tool 10 when it is run down hole.

Figure 2:
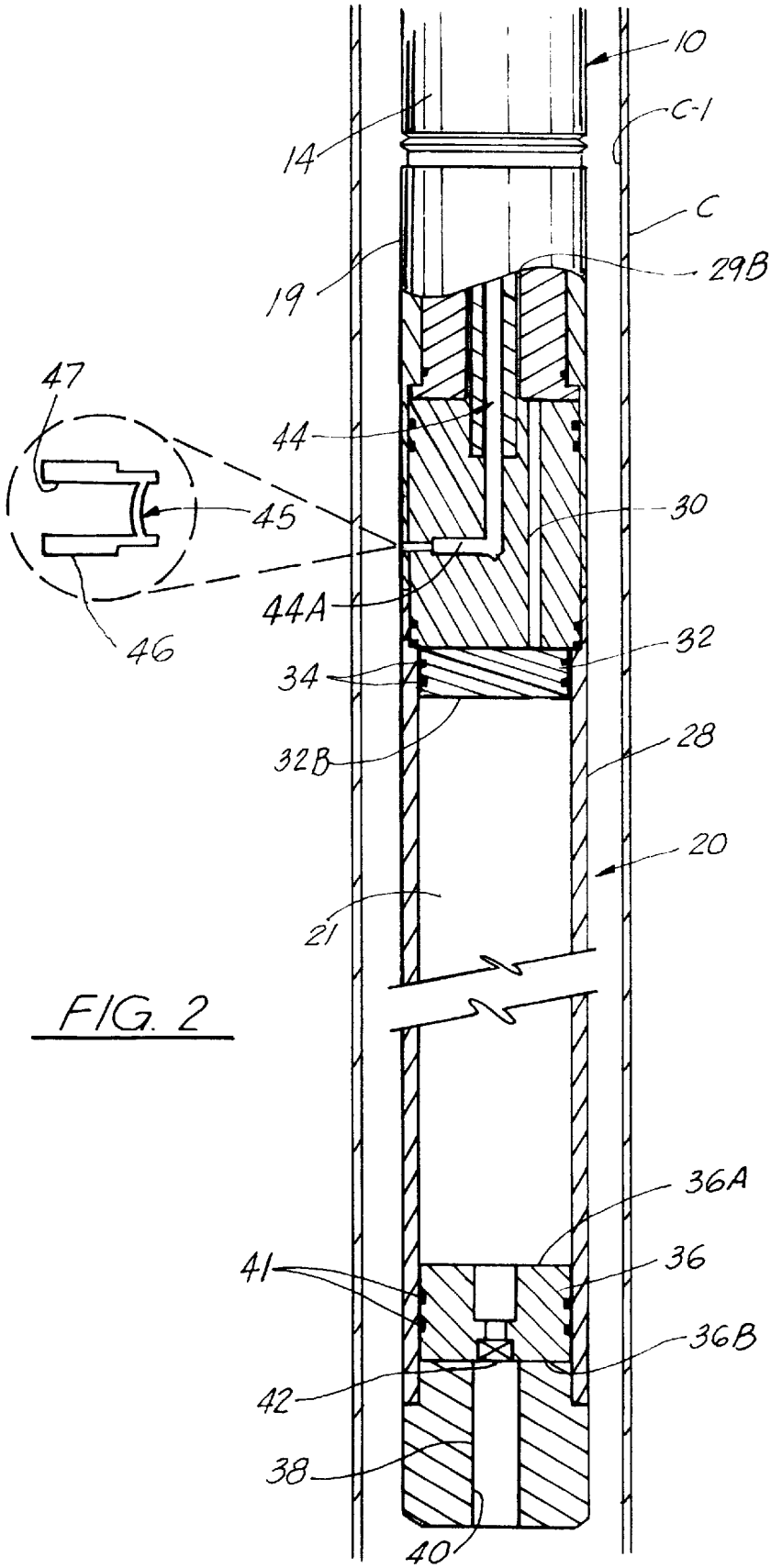
FIG. 2 is a longitudinally extending cross-sectional view of the apparatus of the present invention connected to a tool like the one in FIG. 1, after the apparatus is charged with a compressible gas and before the tool and apparatus are run downhole.

Referring to FIG. 2, the thermal compensating apparatus 20 is illustrated in position within a well having casing C with smooth inner wall C-1. Prior to introduction of the apparatus 20 into the well, a substantially compressible fluid, such as a gaseous nitrogen composition, is introduced under pressure into a chamber 21 as described below. The amount of gas introduced into the chamber 21 is determined by and is dependent upon hydrostatic pressure and the ambient temperature in the well at the anticipated setting depth.

Figure 3:
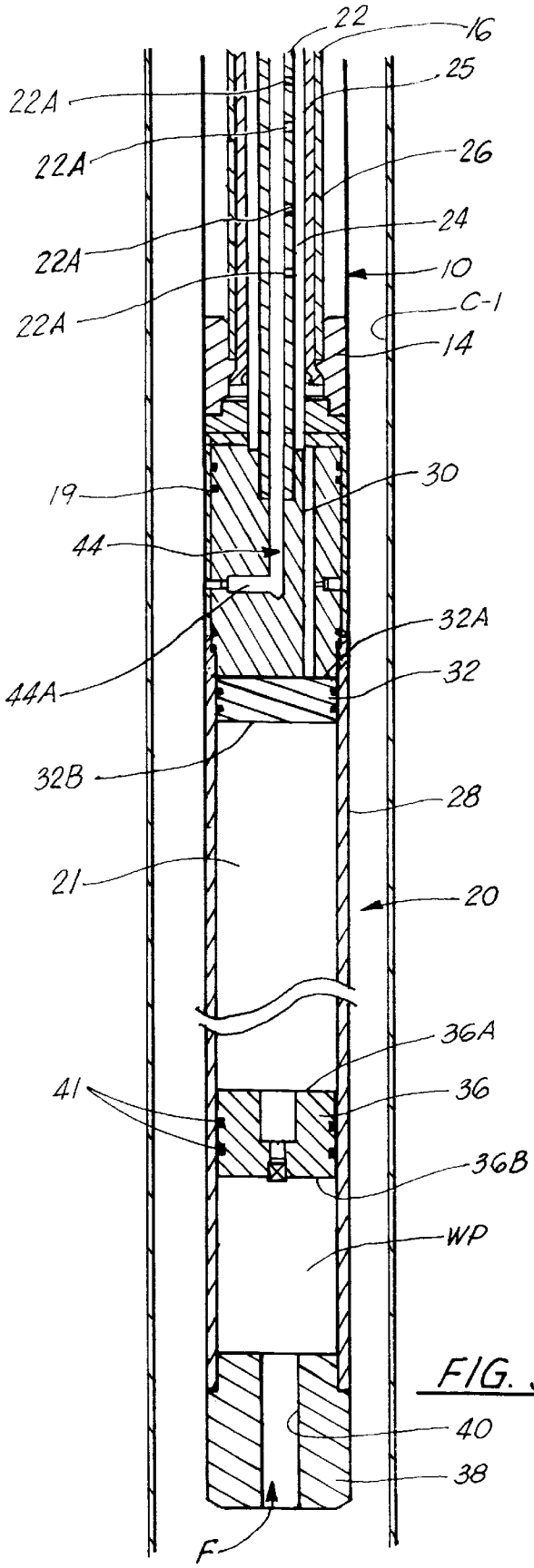
FIG. 3 is a view similar to that of FIG. 2 illustrating additional internal components of the tool and showing the apparatus after it has been run downhole, but before it has been set.

FIG. 3 shows the internal connections between the apparatus 20 and the inflatable packer 10. The tool 10 includes a control mandrel 22 which has a hollow central conduit 22B, through which a substantially incompressible fluid, such as water, a cementitious material, or other known fluid utilized to set inflatable packers, is transmitted when it is desired to set the inflatable packer 10 in the well at the setting depth. A control head at the top of device 10 (not shown) includes a conventional poppet valve mechanism (not shown) which allows pressured fluid to enter into fluid chamber 24 and cause device 10 to expand out to wall C-1 of casing C.

A sheath of the overlapping, longitudinally extending, metallic ribs or slats 16 is disposed around the outside of the elastomeric inflatable bladder 25, in known fashion. An elastomeric cover section 26 (located at the lower end of the tool 10 in FIG. 3, instead of in the center as shown in FIG. 1) is shown schematically, for example, as covering the ribs 16. When the cover section 26 is expanded, it provides a seal between tool 10 and the wall C-1 of the casing C in the well, while expanded exposed section(s) of the ribs 16 operate to anchor the tool 10 in the casing C.

An elongated cylindrical housing 28 is located below the inflatable packer 10 and is secured through a threaded connection to the sleeve 19, which in turn houses an elongated passageway 30 that is offset from the centerline of the apparatus 20 and communicates at its uppermost end with the inflation fluid chamber 24 (FIG. 3).

The chamber 21 (which receives nitrogen or other compressible gas) is separated from the passageway 30 by a primary floating piston 32, which has an upper face 32A facing the passageway 30. The floating piston 32 also has a second or lower face 32B which defines the uppermost end of the compressible gas chamber 21. The piston 32 includes a pair of dynamic elastomeric O-ring seals 34 for providing a fluid seal as the piston 32 moves as described below.

A secondary floating piston 36 is also positioned for movement in the compressible gas chamber 21, and has an upper face 36A which defines the lower end of the chamber 21. The secondary piston 36 also has a lower face 36B which, when the secondary piston 36 is moved to its lowermost position shown in FIG. 2, abuts against an end member 38 that is connected to the lowermost end of the housing 28. The end member 38 has a central bore 40 through which a pump or conduit (not shown) can be inserted to inject a compressible gas into the chamber 21 through a one-way check valve 42 that prevents any discharge of the gas from the chamber 21. The central bore 40 also provides for fluid communication with fluids in the casing C and the lower face 36B of the secondary piston 36, for reasons discussed below. The piston 36 includes a pair of dynamic elastomeric o-ring seals 40 for providing a fluid seal as the piston 36 moves as described below.

Referring to FIG. 3, the fluid conduit 22B, through which actuating fluid for actuating the tool 10 is transmitted under pressure, is also connected to a flow passage 44 located in the apparatus 20, which operates as an extension of the fluid conduit 22B. The flow passage 44 includes a horizontal elbow portion 44A in which a rupture disk 45 is mounted and positioned within a rupture disk housing 46. The rupture disk housing 46 defines a passageway 47, which is blocked by placement of the disk 45.

The rupture disk 45 may be of any known type and constructed such that it will break or shatter upon exposure across its interior face 45A to a predetermined amount of pressure equal to the pressure required to set the inflatable packer tool 10 in the well. When the disk 45 ruptures, a fluid/pressure trapping mechanism closes in the control portion of device 10 (not show) in a manner know to those skilled in the art of using inflatable tools. With the inflation fluid retained, device 10 is considered set in place. Such condition may be detected at the top of the well or at other point by a slight drop in pressure reading in the well conduit (not shown) communicating with the tool 10, which indicates that the tool 10 is set.

FIG. 3 shows the relative positions of the components of the thermal compensating apparatus 20 after it has run into the well, but before the tool 10 is actuated and set against the inner wall C-1 of the casing C. In this position, fluid in the casing C flows through the bore 40 in the end piece 38, as illustrated by the arrow F, and causes hydrostatic well pressure WP to act on the lower face 36B of the secondary piston 36, moving the piston 36 upwardly and compressing the compressible gas that has previously been charged within the chamber 21. At this point in time, the secondary piston 36 has moved to its maximum upper position within the housing 27 at that well pressure.

Figure 4:
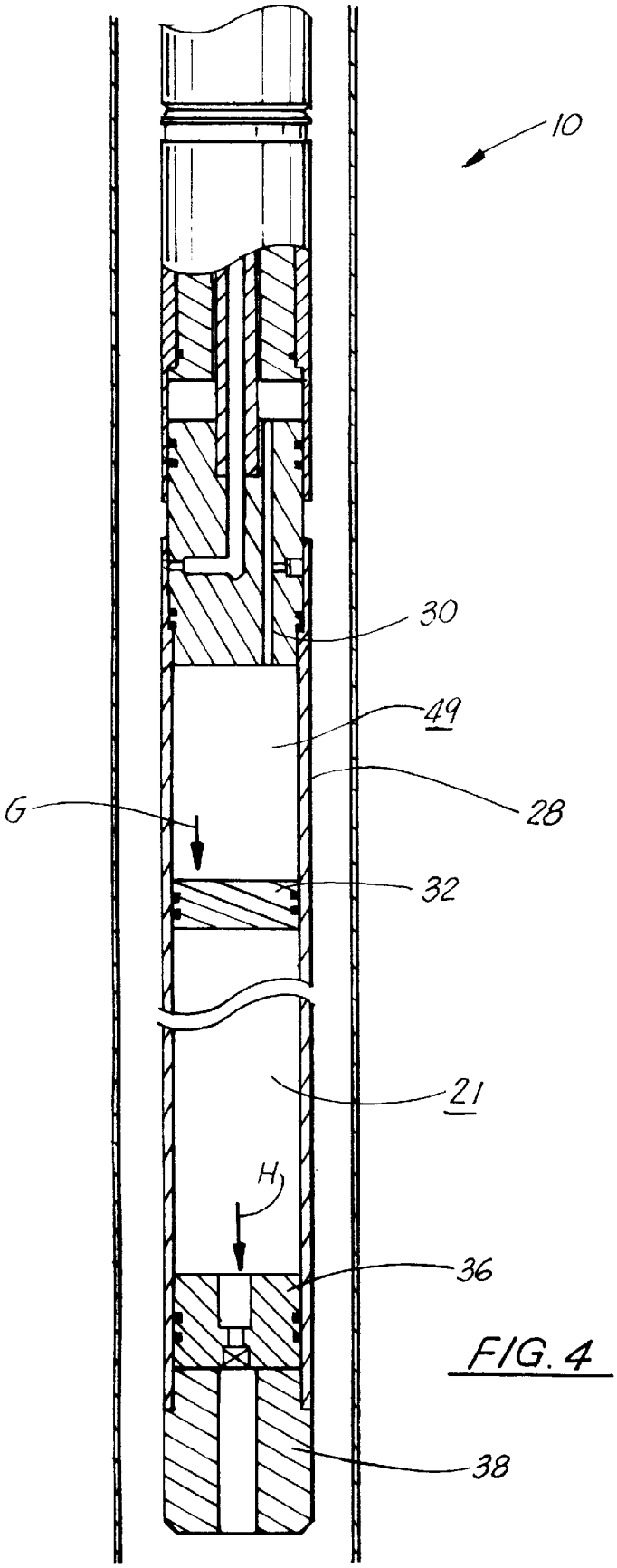
FIG. 4 is a view similar to that of FIGS. 2 and 3, illustrating the apparatus after the tool has been set.

FIG. 4 shows the relative positions of the components of the thermal compensating apparatus 20 after the tool 10 has been set in the well by injecting a substantially incompressible inflation fluid into fluid chamber 24. The fluid flows through the fluid ports past the poppet valve (not show) and into fluid chamber 24 and expands the bladder 25 radially outwardly together with the ribs 16 and cover 26. The inflation fluid also flows through the passageway 30, causing the piston 32 to move downwardly therein creating fluid chamber 49 in the housing 28 in the direction of arrow G and compresses the gas in the chamber 21. The pressure exerted on the on the gas in the chamber 21 also causes the secondary piston 36 to move downwardly in the direction of arrow H into contact with the end piece 38 because pressure substantially in excess of hydrostatic well pressure is required for setting the tool 10.

Figure 5:
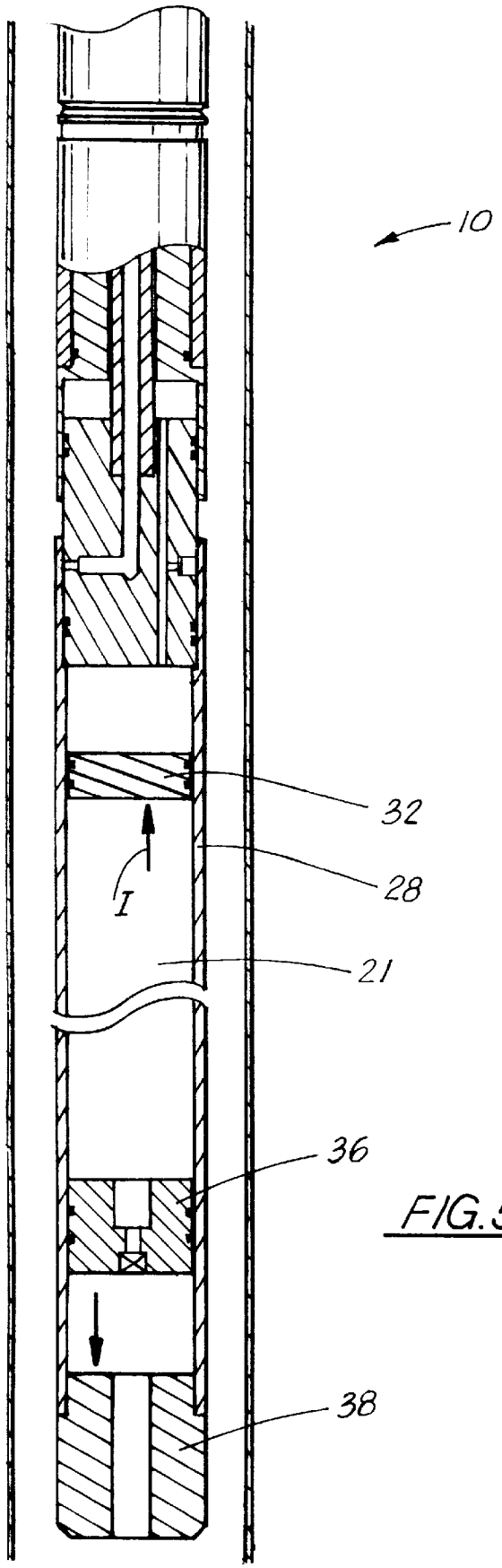
FIG. 5 is a view similar to that of FIGS. 2–4, illustrating movement of the primary piston of the apparatus as a result of a reduction of temperature in the vicinity of the set packer device.

After the tool 10 is set, if the zone in the vicinity of the tool 10 experiences a drop in temperature, the fluid in the tool 10 will contract. When this condition occurs, as shown in FIG. 5, the compressed gas in the chamber 21 causes the floating piston 36 to move upwardly in the direction of arrow I, which in turn operates to maintain a substantially uniform fluid pressure in tool 10 and prevent the anchor and seal from being compromised. The secondary piston 36 remains in contact with the end piece.

Figure 6:
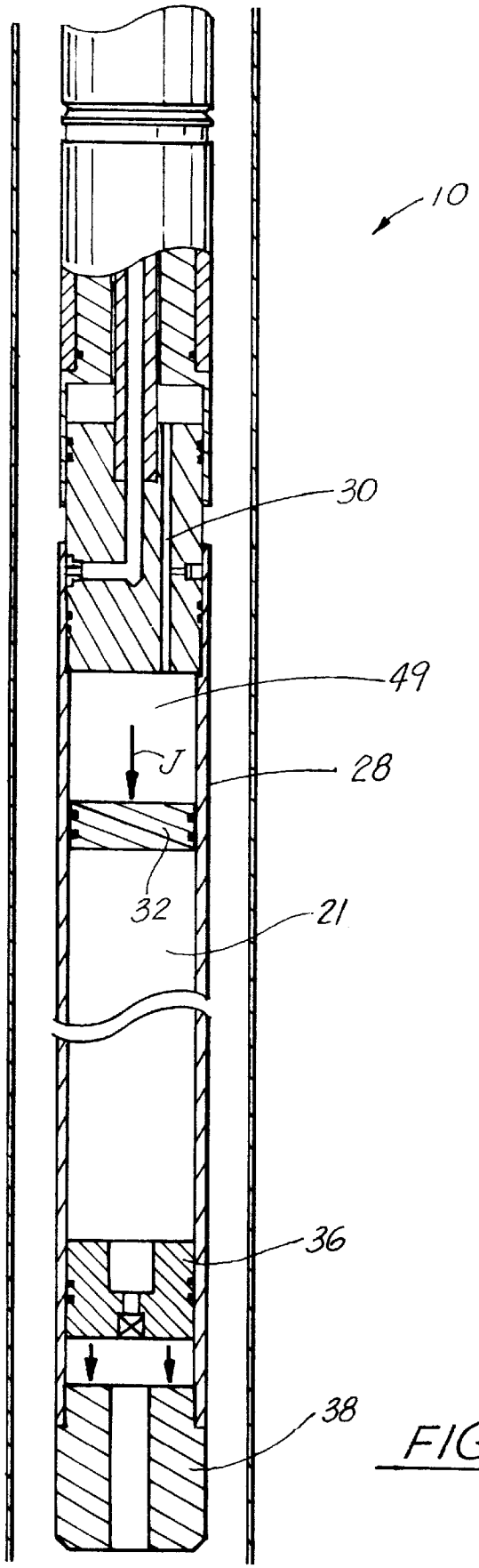
FIG. 6 is a view similar to that of FIG. 5, illustrating movement of the primary piston as a result of an increase in temperature in the vicinity of the set packer device.

The inflation fluid in chambers 24 and 49 will expand in the event of an increase of temperature in the vicinity of the tool 10. Any expansion of fluid within the tool 10 is immediately transmitted through the passageway 30 to the piston 32, causing the piston 32 to move downwardly in the direction of arrow J, as shown in FIG. 6, and compress the gas located in the chamber 21 for maintaining an essentially constant pressure setting integrity and balance.

A thermal compensating apparatus and method have thus been shown and described which maintain a substantially constant fluid pressure in an inflatable downhole tool regardless of the type of temperature variant that the tool encounters. The apparatus utilizes a chamber filled with a compressible gas defined between a pair of floating pistons for accomplishing these results, but providing for advantages not previously available.

Although the invention has been described in terms of specified embodiments which are set forth in detail, it should be understood that this is by illustration only and the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. A thermal compensating apparatus for maintaining a substantially constant fluid pressure within a subterranean well tool, said apparatus comprising:

(a) a body;

(b) first and second fluid chambers within said body, the first fluid chamber housing a first fluid, the second fluid chamber being charged with a second fluid, both chambers defining first volumetric sizes within said body of said tool;

(c) the fluid chambers being operatively connected to each other without transmitting fluid there between so that changes in the volumetric size of the first chamber will change the volumetric size of the second fluid chamber; and (d) a second floating piston in the second fluid chamber, one side of said piston facing compressible fluid in the second fluid chamber and the other side being exposed to hydrostatic well pressure.

2. The thermal compensating apparatus of claim 1, and further comprising a first floating piston operatively connecting the first and second fluid chambers, with one side of the first piston defining a portion of the first fluid chamber and a second side of the first piston defining a portion of the second fluid chamber, with the first piston being movable in response to pressure variations in the first fluid chamber.

3. The thermal compensating apparatus of claim 1, wherein the tool includes a hollow mandrel through which actuating fluid is transmitted, and the first fluid chamber is in fluid communication with the mandrel.

4. The thermal compensating apparatus of claim 1, and further including a one-way check valve in the second piston through which a compressible fluid can be charged into the second fluid chamber.

5. The thermal compensating apparatus of claim 4, and further including a plug for plugging the one-way check valve and preventing well fluid from entering the second fluid chamber.

6. The thermal compensating apparatus of claim 1, further including a fluid passageway in fluid communication with actuating fluid used in activating said tool in said well, and a rupture disk in the passageway set to rupture at a predetermined pressure for setting the tool.

7. A thermal compensating apparatus for maintaining a substantially constant fluid pressure within a subterranean well tool of the type that includes a bladder that is selectively expandable upon the introduction of pressurized actuation fluid for actuating said tool at a location in a well, said apparatus comprising:

(a) a body;

(b) first and second fluid chambers within said body, the first fluid chamber housing a substantially incompressible fluid and communicating with the actuating fluid used for activating said tool in said well, the second fluid chamber being charged with a compressible fluid, both chambers defining first volumetric sizes within said body upon actuation of said tool in said well;

(c) the fluid chambers being operatively connected to each other without transmitting fluid there between so that changes in the volumetric size of the first chamber caused by temperature variations in the actuation fluid will change the volumetric size of the second fluid chamber for maintaining the actuating fluid at a substantially constant pressure; and (d) a second floating piston in the second fluid chamber, one side of said piston facing compressible fluid in the second fluid chamber and the other side being exposed to hydrostatic well pressure.

8. A method for maintaining a substantially constant fluid pressure within a subterranean well tool, said method comprising the steps of:

(a) providing a first fluid chamber containing and in communication with actuation fluid used for activating said tool in said well, and a second fluid chambers charged with a compressible fluid, both chambers defining first volumetric sizes within said body upon actuation of said tool in said well;

(b) including a second floating piston in the second fluid chamber, one side of said piston facing the compressible fluid and the other side being exposed to hydrostatic well pressure; and (c) operatively connecting the fluid chambers to each other without transmitting fluid there between so that changes in the volumetric size of the first chamber caused by temperature variations in the actuation fluid will change the volumetric size of the second fluid chamber for maintaining the actuating fluid at a substantially constant pressure.

9. The method of claim 8, and further comprising the step of operatively connecting the first floating piston to the first and second fluid chambers, with one side of the first piston defining a portion of the first fluid chamber and a second side of the first piston defining a portion of the second fluid chamber, with the first piston being movable in response to pressure variations in the first fluid chamber.

10. The method of claim 8, and further including the step of transmitting the actuating fluid through a hollow mandrel, with the first fluid chamber being in fluid communication with the mandrel.

11. The method of claim 8, further including the step of charging a compressible fluid through a one-way check valve in the second piston.

12. The method of claim 8, and further including the step of plugging the one-way check valve for preventing well fluid from entering the second fluid chamber.

13. The method of claim 8, and further including the step of preventing an over pressure situation in the actuation fluid by providing a passageway in fluid communication with the actuating fluid, and a rupture disk in the passageway set to rupture at a predetermined pressure for setting the tool.

14. Apparatus for maintaining the integrity of inflation pressure within an apparatus set along a wall in a subterranean well, comprising:

(a) a body including a mandrel;

(b) an expandable elastomeric inflatable element disposed around said mandrel;

(c) a cover surrounding said inflatable element and axially moveable outwardly into sealing engagement with the wall of the well upon fluid expansion of said inflatable element;

(d) a passageway communicating with a source of substantially incompressible fluid pressure and extending through said body, said mandrel and said inflatable element for transmission of said fluid pressure to expand said inflatable element;

(e) an inflation fluid chamber within said inflatable element and said body;

(f) a second chamber within said body for receipt of a substantially compressible fluid body;

(g) a first moveable piston having a face forming one end of said second chamber within said body for separating said inflation fluid chamber and said second chamber; and (h) a second moveable piston within said body a face forming one end of said second chamber within said body and another face exposed to hydrostatic pressure within said well and moveable toward said inflation fluid chamber in response to an increase of hydrostatic well pressure upon said another face.

15. The apparatus of claim 14, and further comprising a second moveable piston within said body having a face forming one end of said second chamber within said body and another face exposed to hydrostatic pressure within said well and moveable toward said inflation fluid chamber in response to an increase of hydrostatic well pressure upon said another face.

16. The apparatus of claim 14, wherein said second moveable piston includes a one-way check valve for introducing compressible fluid into said second chamber in one direction and preventing movement of said compressible fluid out of said chamber in another direction.

* * * * *

UNITED STATES PATENT AND TRADEMARK OFFICE

CERTIFICATE OF CORRECTION

PATENT NO. : 6,213,217 B1
DATED : April 10, 2001
INVENTOR(S) : James V. Carisella, et al.

It is certified that error appears in the above-identified patent and that said Letters Patent is hereby corrected as shown below:

Column 2,
Line 39, delete "world wide" and insert -- worldwide -- therefor.

Column 3,
Line 1, delete "effected" and insert -- affected -- therefor.

Column 7,
Line 54, delete "show" and insert -- shown -- therefor.
Line 61, delete the first occurrence of "on the".

Column 9,
Line 41, delete "chambers" and insert -- chamber -- therefor.

Column 10,
Line 41, after "body" please insert -- having --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*